United States Patent [19]

Horn et al.

[11] Patent Number: 4,679,782

[45] Date of Patent: Jul. 14, 1987

[54] MECHANICAL TOGGLE CLAMP WITH MEANS FOR APPLYING UNIFORM CLAMPING FORCE

[75] Inventors: Edward R. Horn, Nashotah; Norbert J. Kot, II, Milwaukee, both of Wis.

[73] Assignee: Aladdin Engineering & Mfg, Brookfield, Wis.

[21] Appl. No.: 802,306

[22] Filed: Nov. 27, 1985

Related U.S. Application Data

[63] Continuation of Ser. No. 688,314, Jan. 2, 1985, abandoned.

[51] Int. Cl.[4] ..... B25B 1/14

[52] U.S. Cl. ..... 269/228

[58] Field of Search ..... 100/291; 269/228, 229-236, 269/93; 81/349

[56] References Cited

U.S. PATENT DOCUMENTS

| | | | |
|---|---|---|---|
| 2,236,439 | 3/1941 | McLenna . | |
| 2,439,483 | 4/1948 | Merriman | 269/229 |
| 2,537,594 | 1/1951 | Lehmann . | |
| 2,815,052 | 12/1957 | Krasnow | 269/236 |
| 2,877,815 | 3/1959 | Fonken | 269/93 |
| 2,972,476 | 2/1961 | Blatt . | |
| 3,129,938 | 4/1964 | Riley | 269/236 |
| 3,273,874 | 9/1966 | Blatt . | |
| 3,302,943 | 2/1967 | Mericle . | |
| 3,347,542 | 10/1967 | Mericle . | |
| 3,381,954 | 5/1968 | Blatt . | |
| 3,482,830 | 12/1969 | Sendoynas . | |

*Primary Examiner*—Robert C. Watson

*Attorney, Agent, or Firm*—Michael, Best & Friedrich

[57] ABSTRACT

A mechanical clamp for releaseably clamping a workpiece against a supporting surface. The clamp engages workpieces of differing thickness without adjustment and applies substantially uniform clamping force on the workpieces despite differences in thickness of the workpieces.

19 Claims, 4 Drawing Figures

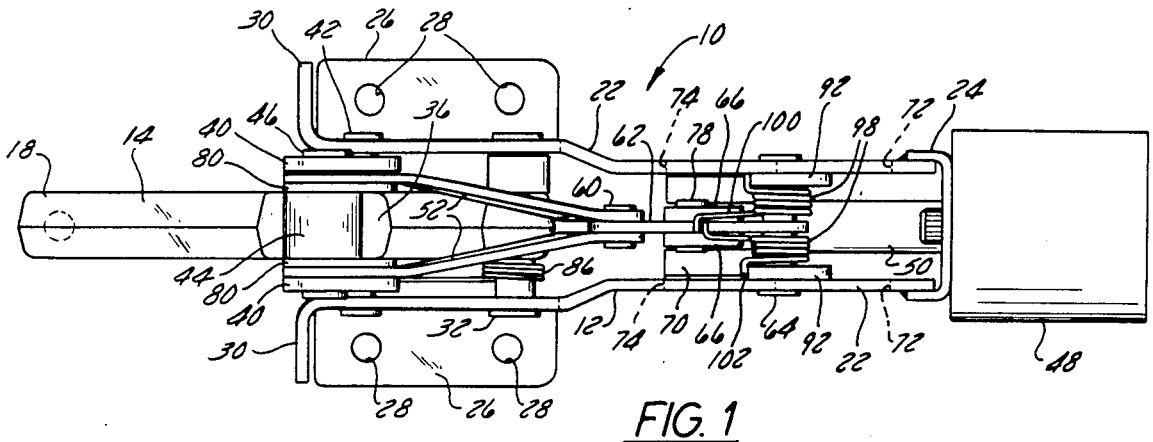
FIG. 1
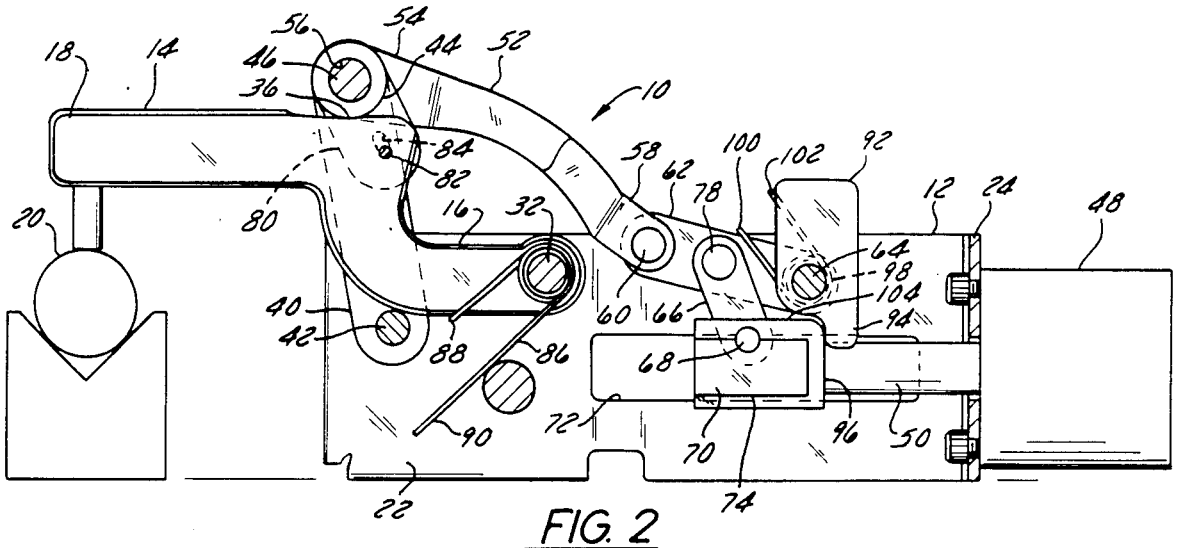
FIG. 2
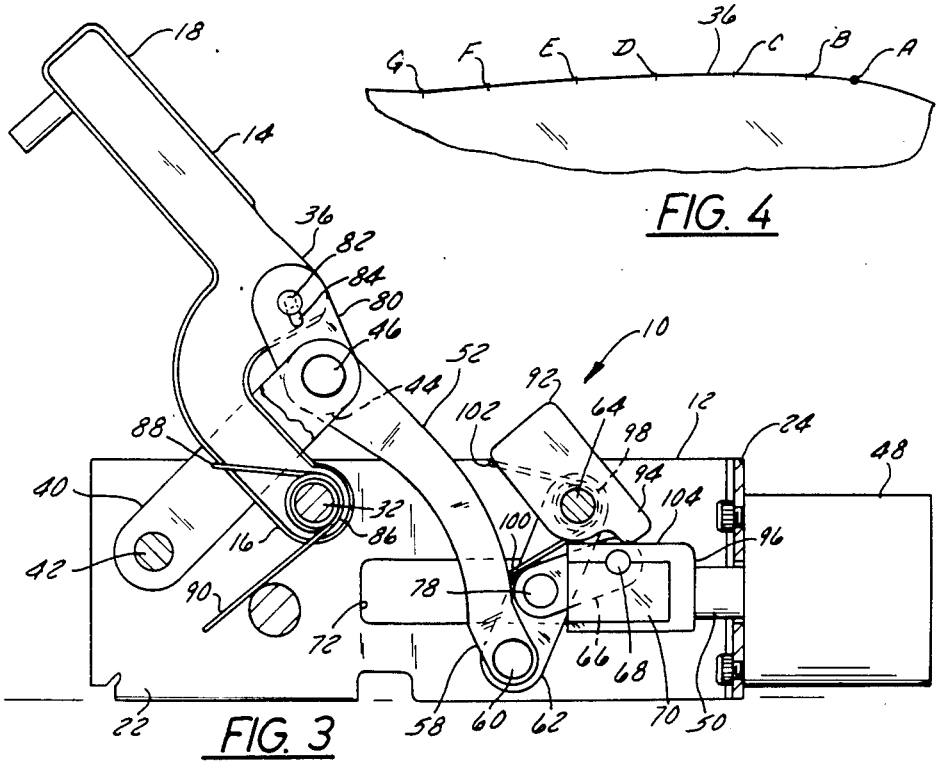
FIG. 3
FIG. 4

MECHANICAL TOGGLE CLAMP WITH MEANS FOR APPLYING UNIFORM CLAMPING FORCE

This application is a continuation of Ser. No. 688,314 filed 1/2/85 now abandoned.

FIELD OF THE INVENTION

The present invention is directed to mechanical clamping apparatus of a type for use in securing a workpiece in place.

BACKGROUND OF THE INVENTION

Mechanical clamps are commonly used in manufacturing processes to clamp a workpiece in place and to secure the workpiece while the workpiece is being machined, welded or otherwise worked.

An example of prior art mechanical clamp apparatus is shown in the U.S. Pat. No. 2,537,594, issued Jan. 9, 1951 and in the U.S. Pat. No. 2,236,439 issued Mar. 25, 1941.

One of the features of the common prior art clamps is that they require adjustment in order to clamp workpieces of differing thicknesses. It is common that the thickness of the workpiece in many applications may vary from one workpiece to the next such that adjustment of the clamp is required for each workpiece if uniform clamping pressure is to be applied. Additionally, in normal practice a plurality of mechanical clamps are required to support each workpiece and adjustment of each one of these clamps is required if workpieces of different dimensions are being clamped.

The mechanical clamps of the type shown in the Lehmann and McKenna patents are intended to be useful to clamp workpieces of varying thicknesses without adjustment of the clamp. For example, these clamps can accommodate workpieces which vary in thickness by as much as approximately 1/16 inch. However, these clamps apply varying clamping forces on the workpiece depending on the thickness of the workpiece. This variation in clamping pressure can result in bending or distortion of the workpiece.

Mechanical clamps of the type of the invention have also included hydraulic or pneumatic motors for applying clamping force. While pneumatic clamps are desirable because compressed air is readily available in many manufacturing facilities, and pneumatic fluid motors employed by the prior art clamps are useful where low clamping forces are sufficient, the pneumatic mechanical clamps of the prior art do not generate sufficient clamping force to be useful in many applications. Hydraulically driven clamps can generate greater clamping forces, but these devices are expensive because they require hydraulic fluid or the combination of pneumatic and hydraulic cylinders.

Attention is also directed to the U.S. Pat. No. 3,482,830 issued Dec. 9, 1969; the U.S. Pat. Nos. 3,381,954; 3,273,878 and 2,972,476 and the U.S. Pat. Nos. 3,302,943 and 3,347,542.

SUMMARY OF THE INVENTION

The present invention provides an improved mechancial clamp for use in holding a workpiece in place. The clamp embodying the invention applies a uniform clamping force on the workpiece despite variations in the thickness in the workpiece from one workpiece to the next. The mechanical clamp embodying the invention can also employ a pneumatic cylinder to generate clamping force, yet provide sufficient clamping pressure on the workpiece that it can be employed in a variety of applications where pneumatically driven mechanical clamps were previously insufficient.

More particularly, the mechanical clamp embodying the invention includes a mechanical clamp for use in clampingly engaging a workpiece and comprising a frame and a clamp member having an end portion supported for movement toward and away from a supporting surface and adapted to clampingly engage a workpiece against the supporting surface, and the clamp member including a cam surface. Means are also provided for pivotally connecting the clamp member to the frame such that the clamp member is pivotally movable between a clamping position and a retracted position. Means are further provided for forcing the end portion of the clamp member into clamping engagement with the workpiece, this means for forcing including a force applying member engageable with the cam surface. The cam surface has a configuration such that when the force applying member engages one of the opposite ends of the cam surface, the force applied by the end portion on the workpiece is approximately equal to the force applied by the end portion when the force applying member engages the other of the opposite ends of the cam surface.

In one embodiment of the invention the force applying member comprises a roller adapted to engage the cam surface.

In one embodiment of the invention the clamp includes a pivot arm having opposite ends, one end pivotally connected to the frame and an opposite end supporting the roller, and means are also provided for selectively forcing the roller into engagement with the cam surface.

In one embodiment of the invention the means for selectively forcing the roller into engagement with the cam surface includes a first toggle lever having one end pivotally connected to the roller, a second toggle lever having one end pivotally connected to the frame and the other end pivotally connected to the other end of the first toggle lever.

In one embodiment of the invention the means for selectively forcing the roller into engagement with the cam surface further includes a fluid motor having a reciprocably movable piston, and a third toggle lever having one end pivotally connected to the second toggle lever intermediate its opposite ends, and the other end of the third toggle lever being pivotally connected to the piston for reciprocal movement with the piston.

One of the advantages of the present invention is that the cam surface of the clamping member or clamping arm is particularly shaped such that the clamping end of the clamping arm applies a substantially constant clamping force on the workpiece even if the workpieces are of varying dimensions.

Another of the advantages of the apparatus embodying the invention is that the toggle arrangement provides for a substantial amplification of the clamping force applied by the pneumatic cylinder to thereby generate sufficient clamping force on the workpiece to hold it securely. The toggle arrangement for supporting the clamp member also includes a means for resisting force by the workpiece on the clamp member during working of the workpiece.

Various other features and advantages of the invention will be apparent by reference to the following description of a preferred embodiment, from the drawings and from the claims.

BRIEF DESCRIPTION OF THE DRAWINGS

FIG. 1 is a plan view of a mechanical clamp embodying the present invention.

FIG. 2 is a side elevation view of the clamp illustrated in FIG. 1.

FIG. 3 is a view similar to FIG. 2 and showing the clamping arm of the mechanical clamp in a release position.

FIG. 4 is a much enlarged side elevation view of a cam surface of the clamp arm embodied in the mechanical clamp illustrated in FIGS. 1–3.

Before describing a preferred embodiment of the invention in detail, it is to be understood that the invention is not limited in its application to the details on construction nor to the arrangement of the components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF A PREFERRED EMBODIMENT

Illustrated in FIG. 1 is a mechanical clamp 10 embodying the present invention. The mechanical clamp 10 includes a frame or base 12 supporting a pivotable clamp arm 14, the clamp arm 14 having one end 16 pivotably supported by the base 12 and an opposite end 18 adapted to clampingly engage a workpiece 20.

While the frame or base 12 could be constructed in various ways, in the particular arrangement illustrated in the drawings, the frame 12 is comprised of a pair of spaced generally parallel metal plates 22 joined at their rearward ends by an end plate 24. Mounting flanges 26 project outwardly from the lower edges of the forward portions of the plates 22. The mounting flanges 26 include bores 28 adapted to house mounting bolts such that the frame or base 12 can be secured to a supporting surface. Similar flanges 30 project outwardly from the forward edges of the side plates 22.

While the clamp arm 14 could be supported by the frame 12 in various ways, in the illustrated construction the end 16 of the clamp arm 14 includes a bore housing a pivot pin 32. The opposite ends of the pivot pin 32 are supported by the spaced apart plates 22 and such that the end 18 of the clamp arm 14 is movable between a clamping position as shown in FIG. 2 and a release position shown in FIG. 3.

While the mechanical clamp 10 is shown in the drawings as supported such that the free end or clamping end 18 of the clamp arm 14 is movable vertically, it will be understood by those skilled in the art that the mechanical clamp 10 embodying the invention can be mounted in many different orientations depending on the application of the clamp 10 and on the required position or orientation of the clamping arm 14.

Referring more specifically to the construction of the clamp arm 14, an upper surface of the clamp arm intermediate its opposite ends defines a cam surface 36 shown greatly enlarged in FIG. 4. As will be explained in greater detail hereinbelow, the configuration of the cam surface 36 facilitates the application of a uniform clamping force on a workpiece 20 clamped by the clamp arm 14 regardless of the relative size of the workpiece if the workpiece is within a range of sizes adapted to be clampingly engaged by the clamp mechanism.

Means are also provided for engaging the cam surface 36 or for applying a force on the cam surface 36 to cause pivotal movement of the clamp arm 14 about the pivot pin 32 and consequently clamping movement of the clamp arm 14. This clamping means includes a pair of links or arms 40 positioned on the opposite sides of the clamp arm 14 and including lower ends pivotally joined by pins 42 to the sides 22 of the frame or base 12. The upper ends of the links 40 support a roller 44 therebetween, the roller 44 being adapted to engage the cam surface 36 and to roll along the cam surface 36 in response to pivotal movement of the pair of arms 40 about the pin 42. The roller 44 is supported on a pin 46 having opposite ends fixed to the upper ends of the links 40, and in a preferred form of the invention the roller 44 is freely rotatable on the pin 46.

Means are also provided for causing selective clamping movement of the roller 44 into engagement with the cam surface 36 of the clamping arm 14. This means includes a fluid motor 48 having an extensible piston 50 and a toggle assembly operably connecting the extensible piston 50 to the roller 44 so as to cause clamping movement of the roller 44 in response to movement of the extensible piston 50. While the fluid motor 48 could comprise a hydraulically actuated piston and cylinder, in a preferred form of the invention the fluid motor 48 can comprise a pneumatic cylinder of the type adapted to be connected to a source of compressed air as is commonly available in conventional manufacturing facilities. It will also be understood by those skilled in the art that the fluid motor 48 for clamping could be replaced by a mechanical or electrical means for causing selective reciprocal movement of a drive member like extensible piston 50.

The toggle assembly operably connecting the extensible piston 50 to the roller 44 is comprised of a first pair of toggle links 52 having opposite ends, the forward ends 54 of these links including bores 56 housing the pin 46 supporting the roller 44. As best shown in FIG. 1, these forward ends 54 of the links 52 are positioned on opposite sides of the clamp arm 14. The rearward ends 58 of the links 52 converge and are pivotally joined by a pin 60 to the forward end of a second toggle link 62. The second toggle link 62 includes a rearward end pivotally connected by a pin 64 to the frame 12 above the linearly extensible piston 50. A third pair of toggle links 66 connect the linearly extensible piston 50 to the second toggle link 62 intermediate its opposite ends. The toggle links 66 are pivotally connected at their lower ends by a pin 68 to a slide member 70, the slide member 70 in turn being supported for linear reciprocal movement along the length of two slots 72 formed in the frame side members 22. The slide member 70 is supported by a pair of tabs 74 which extend outwardly into the slots 72 and are supported therein for linear reciprocal movement. The piston 50 of the pneumatic cylinder is operably connected to the slide 70 to cause linear reciprocal movement of the slide 70 in response to movement of the piston. The third toggle links 66 have upper ends connected by a pin 78 to the second toggle link 62 intermediate its opposite ends.

In operation of the clamp 10 illustrated in the drawings, when the clamp arm 14 is in the open position shown in FIG. 3, and when compressed air is then supplied to the pneumatic cylinder 48, the slide member 70 is forced forwardly toward the workpiece 20. The third toggle links 66 apply a forward and upward force on the second toggle link 62 and thereby cause the second toggle link 62 to apply a forward and upward force on the ends 58 of the first toggle links 52. The roller 44, supported by the forward ends 54 of the first toggle links 52 and the upper ends of the arms 40, engages the cam surface 36, and as the roller 44 is forced forwardly by the links 52 along the cam surface 36, it causes continued pivotal movement of the clamp arm 14 in a counterclockwise direction as seen in FIGS. 2 and 3 until the clamp arm clampingly engages the workpiece. In the event a relatively large workpiece is being engaged by the clamp arm 14, the roller 44 will be positioned on a first portion of the cam surface 36. If a relatively small workpiece is clampingly engaged, the roller 44 will move farther to the left on the cam surface 36 to the position shown in FIG. 2.

In operation of the clamp, workpieces being clamped in place may vary in thickness. The clamp embodying the present invention includes means for clamping workpieces which may vary in thickness by 1/16 inch or more while also applying approximately the same clamping force on successive workpieces. The cam surface 36 of the clamping arm 14 permits movement of the roller 44 along the cam surface 36 until the clamping end 18 of the clamp arm 14 clampingly engages the workpiece. However, regardless of the relative position of the roller 44 on the cam surface 36, the configuration of the cam surface is such that the force applied by the clamping arm 14 is relatively constant. The force applied by the end 18 of the clamping arm 14 is a product of the downward force applied by the roller 44 against the cam surface 36 and the length of the moment arm, i.e. the distance between the pivot axis of the clamp arm 14 and the point where force is applied by the roller on the cam surface. The length of the moment arm is also dependent on the direction of the force on the cam surface. As the roller 44 moves along the cam surface 36 and away from the pivot axis of the clamping arm 14, the moment arm increases. The cam surface 36 of the clamping arm is particularly shaped such that as the roller moves along the cam surface, the product of the clamping force applied by the roller on the cam surface and the length of the moment arm will be substantially constant regardless of the relative position of the roller 44 on the cam surface 36.

Reference will now be made more specifically to the configuration of the cam surface 36 shown in FIG. 4, and while the clamp 10 embodying the invention may be constructed in various sizes, in the one example of the invention shown there, the cam surface 36 will be constructed such that, when the clamp arm 14 is oriented such that its upper surface is horizontal, Point A on FIG. 4 will be located 1.481 inches above the longitudinal axis of the pivot pin 32 and 1.464 inches to the left of that longitudinal axis as seen in FIG. 4. The cam surface 36 has a configuration such that, in a mechanical clamp 10 wherein the clamp arm 14 is positioned as shown in FIG. 2 and having a Point A located as defined above, Point B will be located 1.487 inches above the longitudinal axis of pivot pin 32 and 1.577 inches to the left of that axis. Point C will be located 1.487 inches above the longitudinal axis and 1.675 inches to the left of that axis. Point D will be located 1.484 inches above that longitudinal axis and 1.747 inches to the left of that axis. Point E will be located 1.480 inches above that longitudinal axis and 1.801 inches to the left of that axis. Point F will be located 1.477 inches above that longitudinal axis and 1.846 inches to the left of that longitudinal axis. Point G will be located 1.476 inches above that longitudinal axis and 1.891 inches to the left of that longitudinal axis. The surface to the left of Point G is planar and comprises the horizontal upper portion of the clamp arm.

With the cam surface having this configuration, the force applied by the clamping end 18 of the clamp arm 14 on the workpiece will be approximately constant regardless of the position of the roller 44 on the cam surface 36 due to variations in size of the workpiece being clamped.

Means are also provided for causing the clamping arm 14 to move to the retracted position as shown in FIG. 3 in response to retraction of the piston 50 of the pneumatic cylinder 48. While the means for causing retraction could have various constructions, in the illustrated arrangement, it includes a pair of relatively short links 80 each having one end pivotally supported by the pins 46 supporting the roller 44 and an opposite end pivotally connected by a pin 82 to the clamp arm 14 intermediate the opposite ends of the clamp arm 14. The short links 80 are positioned on opposite sides of the clamp arm 14 and each include a slot 84 housing the pin 82 connecting the links 80 to the clamp arm 14, and the slots 84 provide limited movement of the roller 44 away from the cam surface 36 of the clamp arm 14. The slots 84 are located such that when the clamp arm 14 is in the clamping position shown in FIG. 2, the roller 44 is movable with respect to the pin 82 such that the roller 44 can move along the cam surface 36. When the piston 50 of the pneumatic cylinder 48 is retracted, and the toggle linkages 52, 62 and 66 are moved to the position shown in FIG. 3, the links 80 pull upwardly and rearwardly on the clamp arm 14 to move the clamp arm from the clamping position of FIG. 2 to the open position of FIG. 3.

Means are also provided for resiliently biasing the clamp arm 14 toward the clamp disengaged position. In the illustrated construction that means includes a torsion spring 86 surrounding the pin 82 supporting the clamp arm 14, one end 88 of the torsion spring engaging the clamp arm and an opposite end 90 engaging to the frame 12.

In the illustrated arrangement means are also provided for selectively locking the clamp arm 14 in the clamping position shown in FIG. 2. This means includes a pivotable locking member 92 supported for relatively free pivotal movement about the pivot pin 64 supporting the rearward end of the toggle link 62. The locking member 92 includes a finger 94 extending downwardly and adapted to engage a rearward surface 96 of the slide 70 to releaseably hold the slide 70 in its forward or extended position when the clamping arm 14 is in its clamping position. A torsion spring 98 is also provided for applying a resilient force on the locking member 92 to cause rotation of the locking member 92 about the pivot pin 64 in a clockwise direction as seen in FIG. 2 and such that the finger 94 engages the rearward surface 96 of the slide 70 and biases it toward the clamping position. In the illustrated arrangement a pair of torsion springs 98 are provided on opposite sides of the locking member 92, one of the ends 100 of each of these springs 98 being supported by the toggle link 62 and the other of the ends 102 of the springs 98 engaging the locking member and applying a torque on the locking member 92 in the clockwise direction as seen in FIGS. 2 and 3.

In operation of the locking member 92, and when the clamping arm 14 is moved from the position shown in FIG. 3 to the position shown in FIG. 2, as the piston 50 of the pneumatic cylinder 48 is extended and the slide 70 moves toward the workpiece 20, the finger 94 of the locking member 92 will slide along the upper surface 104 of the slide 70. As the slide 70 approaches its forward position, the finger 94 will move past the rearward end 96 of the slide 70, and the locking member 92 will pivot from the position shown in FIG. 3 to the position shown in FIG. 2. In this position the torsion springs 98 continues to apply a torque on the locking member 92 such that the finger 94 applies a forward force on the rearward end 96 of the slide 70. This forward force on the slide 70 is in addition to the forward force on the slide applied by the pneumatic cylinder 48. Thus once the clamp arm 14 is moved to the clamping position, the clamping force on the clamp arm 14 is increased by the force applied by the locking member 92. Additionally, in the event there is an interruption in the clamping force applied by the pneumatic piston 48, caused, for example, by an interruption of the supply of compressed air to the pneumatic cylinder 48, the locking member 92 will maintain a forward force on the slide 70 to resist movement of the clamping arm 14 to an open position.

When air pressure is supplied to the pneumatic cylinder 48 to cause retraction of the piston 50 and movement of the clamp arm 14 to an open position, the force of the piston 50 is sufficient to overcome the forward force of the finger 94 generated by the torsion springs 98.

While in the illustrated arrangement the mechanical clamp 10 is illustrated as including a single clamping arm 14, and a single toggle arrangement for moving this clamping arm, it will be understood by those skilled in the art that the illustrated apparatus could also be used in back-to-back relation so as to form a gripper with a pair of clamp arms movable toward and away from each other and with a pair of toggle arrangements provided for causing selective clamping movement of the clamp arms.

One of the advantages of the toggle arrangement described above is that it provides high clamping forces on the clamp arm 14 and provides a means for maintaining the clamp arm in clamping engagement with the workpiece 20 without employing an overcenter toggle arrangement. Apparatus using an overcenter toggle construction requires deformation of the toggle links or pivot pins joining the links as the toggle links move overcenter. The high loads placed on the components and their deformation can result in rapid wear of these parts and a short useful life of the mechanical clamp. In mechanical clamps used in manufacturing operations, the clamps may be subjected to very high operating cycles, and a commercially useful clamp must have a long useful life. Applicants's construction provides a clamp capable of a long useful life while also achieving high clamping forces and providing a means for locking the clamp member in the clamping position.

Various features of the invention are set forth in the following claims.

We claim:

1. A mechanical clamp for use in clampingly engaging a workpiece, the mechanical clamp comprising:

a frame, a clamp member having an end portion supported for movement toward and away from a supporting surface and adapted to clampingly engage a workpiece against the supporting surface, said clamp member including a cam surface, means for pivotally connecting said clamp member to the frame such that the clamp member is pivotally movable between a clamping position wherein said end portion of the clamp member clampingly engages the workpiece against the supporting surface and a retracted position wherein said end portion releases the workpiece, and means for forcing said end portion of said clamp member into clamping engagement with the workpiece, said means for forcing including a force applying member engageable with said cam surface, said cam surface having opposite ends and a configuration such that said end portion of said clamp member is spaced from the supporting surface by a first dimension when the force applying member engages said one of said opposite ends of said cam surface and said end portion of said clamp member is spaced from the supporting surface by a second dimension when the force applying member engages the other of the opposite ends of said cam surface and such that the force applied by said end portion on said workpiece when said force applying member engages one of said opposite ends of said cam surface is substantially equal to the force applied by said end portion on said workpiece when said force applying member engages the other of said opposite ends of said cam surface.

2. A mechanical clamp as set forth in claim 1 wherein said force applying member includes a roller adapted to engage said cam surface.

3. A mechanical clamp as set forth in claim 2 and further including an arm having opposite ends, one end pivotally connected to said frame and an opposite end supporting said roller, and means for selectively forcing said roller into engagement with said cam surface.

4. A mechanical clamp as set forth in claim 3 wherein said means for selectively forcing said roller into engagement with said cam surface includes a first toggle lever having opposite ends, one of said opposite ends being pivotally connected to said roller, a second toggle lever having opposite ends, one of said second toggle lever opposite ends being pivotally connected to said frame and the other of said second toggle member opposite ends being pivotally connected to the other of said opposite ends of said first toggle lever.

5. A mechanical clamp as set forth in claim 4 wherein said means for selectively forcing said roller into engagement with said cam surface further includes a fluid motor having a reciprocably movable piston, said piston having a longitudinal axis, means for restraining said piston for linear reciprocal movement, and a third toggle lever having opposite ends, one of said third toggle lever opposite ends being pivotally connected to said second toggle lever intermediate its opposite ends, and the other of said third toggle lever opposite ends being pivotally connected to said piston for reciprocal movement with said piston.

6. A mechanical clamp as set forth in claim 5 and further including spring means for resiliently biasing said clamp member toward said retracted position.

7. A mechanical clamp for use in clampingly engaging a workpiece, the mechanical clamp comprising:

a frame, a clamp member having an end portion supported for movement toward and away from a supporting surface and adapted to clampingly engage a workpiece against the supporting surface, said clamp member including a cam surface, means for pivotally connecting said clamp member to the frame such that the clamp member is pivotally movable between a clamping position wherein said end portion of the clamp member clampingly engages the workpiece against the supporting surface and a retracted position wherein said end portion releases the workpiece, and means for forcing said end portion of said clamp member into clamping engagement with the workpiece, said means for forcing including a roller engageable with said cam surface, said cam surface having opposite ends and a configuration such that the force applied by said end portion on said workpiece when said force applying member engages one of said opposite ends of said cam surface is substantially equal to the force applied by said end portion on said workpiece when said force applying member engages the other of said opposite ends of said cam surface, and an arm having opposite ends, one end pivotally connected to said frame and an opposite end supporting said roller, and means for selectively forcing said roller into engagement with said cam surface, and said means for selectively forcing said roller into engagement with said cam surface including a first toggle lever having opposite ends, one of said opposite ends being pivotally connected to said roller, a second toggle lever having opposite ends, one of said second toggle lever opposite ends being pivotally connected to said frame and the other of said second toggle member opposite ends being pivotally connected to the other of said opposite ends of said first toggle lever.

8. A mechanical clamp as set forth in claim 7 wherein said means for selectively forcing said roller into engagement with said cam surface further includes a fluid motor having a reciprocably movable piston, said piston having a longitudinal axis, means for restraining said piston for linear reciprocal movement, and a third toggle lever having opposite ends, one of said third toggle lever opposite ends being pivotally connected to said second toggle lever intermediate its opposite ends, and the other of said third toggle lever opposite ends being pivotally connected to said piston for reciprocal movement with said piston.

9. A mechanical clamp as set forth in claim 8 and further including spring means for resiliently biasing said clamp member toward said retracted position.

10. A mechanical clamp for use in clampingly engaging a workpiece, the mechanical clamp comprising;

a frame, a clamp member having an end portion supported for movement toward and away from a supporting surface and adapted to clampingly engage a workpiece against the supporting surface, means for connecting said clamp member to the frame such that the clamp member is pivotally movable between a clamping position wherein said end portion of the clamp member clampingly engages the workpiece against the supporting surface and a retracted position wherein said end portion releases the workpiece, and means for forcing said end portion of said clamp member into clamping engagement with the workpiece, said means for forcing including a force applying member and a cam surface, said force applying member being engageable with said cam surface, and said cam surface having opposite ends and a configuration such that the force applied by said end portion on said workpiece when said force applying member engages one of said opposite ends of said cam surface is substantially equal to the force applied by said end portion when said force applying member engages the other of said opposite ends of said cam surface, and an arm having opposite ends, one end pivotally connected to said frame and an opposite end supporting said force applying member, and means for selectively forcing said force applying member into engagement with said cam surface, said means for selectively forcing said force applying member into engagement with said cam surface includes a first toggle lever having opposite ends, one of said opposite ends being pivotally connected to said force applying member, a second toggle lever having opposite ends, one of said second toggle lever opposite ends being pivotally connected to said frame and the other of said second toggle member opposite ends being pivotally connected to the other of said opposite ends of said first toggle lever.

11. A mechanical clamp as set forth in claim 10 wherein said means for selectively forcing said force applying member into engagement with said cam surface further includes a motor having a reciprocably movable member and means for supporting said reciprocably movable member for linear reciprocal movement, and a third toggle lever having opposite ends, one of said third toggle lever opposite ends being pivotally connected to said second toggle lever intermediate its opposite ends, and the other of said third toggle lever opposite ends being pivotally connected to said reciprocably movable member for reciprocal movement with said reciprocably movable member.

12. A mechanical clamp as set forth in claim 11 and further including spring means for resiliently biasing said clamp member toward said retracted position.

13. A mechanical clamp for use in clampingly engaging a workpiece, the mechanical clamp comprising:

a frame, a clamp member having an end portion supported for movement toward and away from a supporting surface and adapted to clampingly engage a workpiece against the supporting surface, means for pivotally connecting said clamp member to the frame such that the clamp member is pivotally movable between a clamping position wherein said end portion of the clamp member clamps the workpiece against the supporting surface and a retracted position wherein said end portion releases the workpiece, and means for forcing said end portion of said clamp member into clamping engagement with the workpiece, said means for forcing including a force applying member engageable with said clamp member, an arm having opposite ends, one end pivotally connected to said frame and an opposite end supporting said force applying member, and means for selectively forcing said force applying member into engagement with said clamp member, said means for selectively forcing said force applying member into engagement with said clamp member including a first toggle lever having opposite ends, one of said opposite ends being pivotally connected to said force applying member, a second toggle lever having opposite ends, one of said second toggle lever opposite ends being pivotally connected to said frame and the other of said second toggle member opposite ends being pivotally connected to the other of said opposite ends of said first toggle lever.

14. A mechanical clamp as set forth in claim 13 wherein said means for selectively forcing said force applying member into engagement with said clamp member further includes a fluid motor having a reciprocably movable piston, said piston having a longitudinal axis, means for restraining said piston for linear reciprocal movement, and a third toggle lever having opposite ends, one of said third toggle lever opposite ends being pivotally connected to said second toggle lever intermediate its opposite ends, and the other of said third toggle lever opposite ends being pivotally connected to said piston for reciprocal movement with said piston.

15. A mechanical clamp as set forth in claim 14 and further including spring means for resiliently biasing said clamp member toward said retracted position.

16. A mechanical clamp for use in clampingly engaging respective workpieces, the workpieces including a first workpiece having a first thickness and a second workpiece having a second thickness greater than the thickness of the first workpiece, the mechanical clamp comprising:

a frame, a clamp member supported by said frame for movement between a retracted position and a clamping position wherein a portion of the clamp member can engage a selected one of the workpieces to clamp the selected one of the workpieces in place, and means for forcing said clamp member into clamping engagement with the selected one of the workpieces such that said portion of said clamp member clampingly engages the selected one of the workpieces, the means for forcing including means for causing said portion of the clamp member to apply a first selected predetermined load on the first workpiece when said portion of the clamp member clampingly engages the first workpiece, and causing said portion of the clamp member to apply a second selected predetermined load on the second workpiece when said portion of the clamp member clampingly engages the second workpiece, and the means for forcing the clamp member into engagement including a cam member having a cam surface and a cam follower engageable with the cam surface, the cam surface being shaped such that said portion of the clamp member will apply said first selected predetermined load on the first workpiece when said cam follower engages a first portion of the cam surface, and wherein said portion of the clamp member will apply said second selected predetermined force on said second workpiece when said cam follower engages the second portion of the cam surface.

17. A mechanical clamp as set forth in claim 16 wherein the first selected predetermined load applied by said portion of the clamp member on the first workpiece is substantially the same as the second selected predetermined load applied by said portion of the clamp member on the second workpiece.

18. A mechanical clamp as set forth in claim 16 wherein the cam surface comprises a portion of the clamp member.

19. A mechanical clamp for use in clampingly engaging a workpiece, the mechanical clamp comprising:

a frame, a clamp member having a portion supported for movement toward and away from a supporting surface and adapted to clampingly engage a workpiece against the supporting surface, means for connecting said clamp member to the frame such that the clamp member is movable between a clamping position wherein said portion of the clamp member clampingly engages the workpiece against the supporting surface and a retracted position wherein said portion of said clamp member releases the workpiece, and means for forcing said portion of said clamp member into clamping engagement with the workpiece, said means for forcing including a cam surface and a force applying member engageable with said cam surface, said cam surface having a configuration such that said portion of said clamp member is spaced from the supporting surface by a first dimension when the force applying member engages a first portion of said cam surface and said portion of said clamp member is spaced from the supporting surface by a second dimension when the force applying member engages a second portion of said cam surface and such that the force applied by said portion of said clamp member on said workpiece when said force applying member engages said first portion of said cam surface is substantially equal to the force applied by said portion of said clamp member on said workpiece when said force applying member engages said second portion of said cam surface.

* * * * *